US007221772B2

(12) United States Patent
Evenisse et al.

(10) Patent No.: US 7,221,772 B2
(45) Date of Patent: May 22, 2007

(54) ELECTRONIC DEVICE COMPRISING A LOUDSPEAKER UNIT

(75) Inventors: Michel Evenisse, Fontaine-Milon (FR); Patrice Fremanteau, Villeveque (FR); Cornelius Sperle, Angers (FR)

(73) Assignee: Thomson Licensing, Boulogne-Billancourt (FR)

( * ) Notice: Subject to any disclaimer, the term of this patent is extended or adjusted under 35 U.S.C. 154(b) by 246 days.

(21) Appl. No.: 10/323,148

(22) Filed: Dec. 18, 2002

(65) Prior Publication Data

US 2003/0138123 A1 Jul. 24, 2003

(30) Foreign Application Priority Data

Dec. 19, 2001 (EP) ..... 01403301

(51) Int. Cl.
*H04R 25/00* (2006.01)

(52) U.S. Cl. ..... 381/386; 381/87; 381/392; 381/395

(58) Field of Classification Search ..... 381/87, 381/189, 333, 354, 386–389, 392–395; 181/150, 181/199
See application file for complete search history.

(56) References Cited

U.S. PATENT DOCUMENTS 4,484,658 A * 11/1984 Grote ..... 381/386
4,852,178 A * 7/1989 Inkman et al. ..... 381/87
5,299,766 A * 4/1994 Curtis et al. ..... 381/386
5,640,461 A 6/1997 Ebert et al.
6,035,962 A * 3/2000 Lin ..... 381/386
6,504,939 B1 * 1/2003 Fukuda ..... 381/386
6,675,930 B2 * 1/2004 Sugiyama et al. ..... 181/150
6,760,460 B1 * 7/2004 Jeon ..... 381/388

FOREIGN PATENT DOCUMENTS

GB 2312130 10/1997
GB 2349037 10/2000

OTHER PUBLICATIONS

Patent Abstracts of Japan, vol. 014, No. 451, Sep. 27, 1990, & JP 02 179097.
Patent Abstracts of Japan, vol. 1998, No. 08, Jun. 30, 1998, & JP 10 066179.
Search Report for EPO Appln. No. 01403301 dated Oct. 22, 2002.

* cited by examiner

*Primary Examiner*—Suhan Ni
(74) *Attorney, Agent, or Firm*—Joseph J. Laks; Harvey D. Fried; Patricia Verlangieri

(57) ABSTRACT

An electronic device has a loudspeaker unit and a casing with a support, which receives the loudspeaker unit, and with a wall perpendicular to the mounting direction of the loudspeaker unit in the support.

A vibration absorbing body forms a spacer between the loudspeaker unit and the support. An abutment protruding from the wall in the mounting direction contacts the vibration absorbing body.

11 Claims, 6 Drawing Sheets

FIG. 3
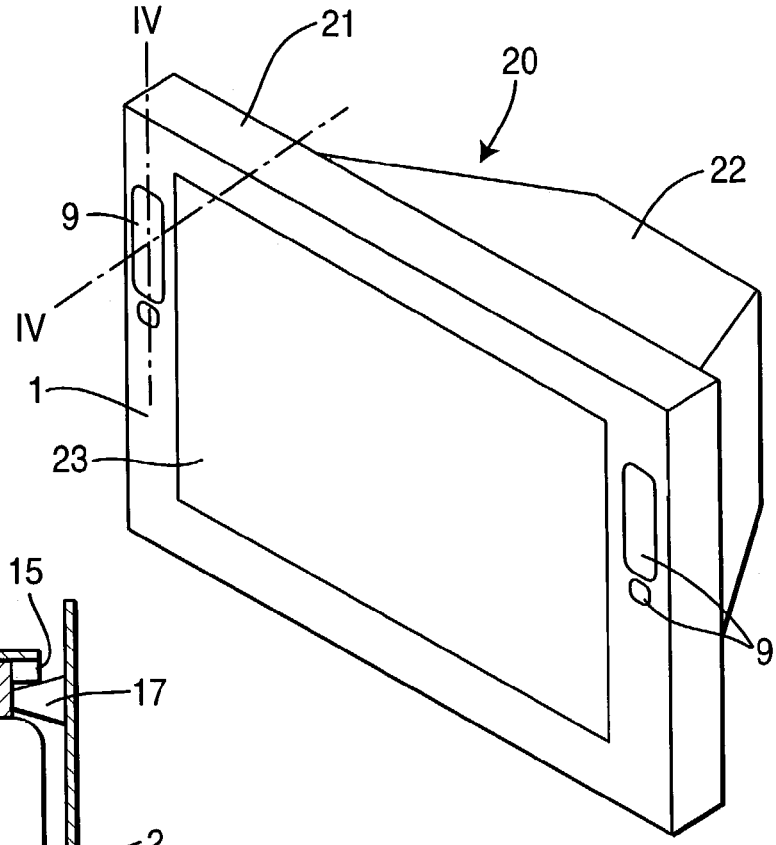
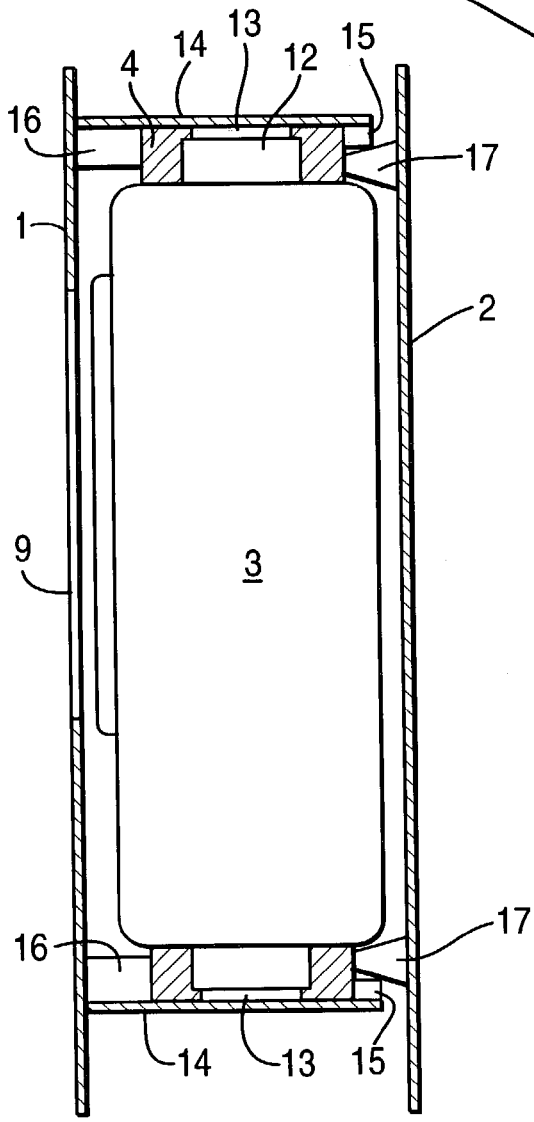
FIG. 4

ELECTRONIC DEVICE COMPRISING A LOUDSPEAKER UNIT

FIELD OF THE INVENTION

The present invention relates to an electronic device such as a TV set, a radio etc. having a casing in which a loudspeaker unit is mounted.

BACKGROUND OF THE INVENTION

When assembling such an electronic device, mounting the loudspeakers is more problematic than mounting of most other components of the device, because the way the loudspeaker is mounted has a critical influence on the quality of sound generated by the device. This quality is seriously impaired if the loudspeaker can excite audible resonances of the casing. In TV sets a further problem is that color reproduction at a CRT tube may be degraded if sound waves from a loudspeaker can excite the mask of the tube to vibrate with respect to the electron beam.

Conventionally, therefore, loudspeakers have been mounted in such devices by screwing them to a support region of the casing with a body of vibration absorbing material being placed as a spacer between the casing and the loudspeaker.

Mounting a loudspeaker in this way is not completely satisfying for a number of reasons. One is that assembly by screws is either time consuming, when the screws are placed one by one, or expensive, if a special tool is required for mounting several screws at a time. Another reason is that it is difficult to find the optimum tightness of the screws. If they are not tight enough, the speaker as a whole may tremble within the casing, causing unpleasant noise; if the screws are too tight, the vibration absorbing body may be compressed to such an extent that it looses its vibration dampening efficiency.

It is therefore an object of the present invention to provide an electronic device in which a loudspeaker is reliably prevented from exciting vibrations of the casing and for which manufacturing costs, in particular for mounting one or more loudspeakers, can be kept low. Patent application GB-A-2 312 130 proposes to mount a loudspeaker into a video display apparatus with interposition of an elastic gasket using a snap-fit arrangement. First, an elastic gasket may create resonances because of its flexibility. Furthermore, the proposed gasket surrounds the loudspeaker and this solution therefore needs a lot of space to be implemented.

SUMMARY OF THE INVENTION

The invention proposes an improved solution, according to which an electronic device comprises a loudspeaker unit, a casing with a first support for receiving the loudspeaker unit in a mounting direction and with a wall perpendicular to the mounting direction, at least one vibration absorbing body forming a spacer between the loudspeaker unit and the first support, wherein that at least one abutment protruding from the wall in the mounting direction contacts the vibration absorbing body.

The abutment allows usage of a vibration absorbing body of reduced size.

According to other features of the invention:

the vibration absorbing body is made of foamed plastic material:

the vibration absorbing body is shorter than the loudspeaker unit in the mounting direction;

the support has lateral ridges so as to form rails adapted to guide a displacement of the loudspeaker unit in the mounting direction;

a second vibration absorbing body forms a spacer between the loudspeaker unit and a second support of the casing;

the loudspeaker unit as a rectangular projection carrying the vibration absorbing body;

the rectangular projection is provided with at least one pin contacting the vibration absorbing body;

a plate is mounted to the first support in the mounting direction and stops the vibration absorbing body;

the plate is adhesively bonded to the vibration absorbing body;

a protrusion of the plate engages a recess in the vibration absorbing body.

BRIEF DESCRIPTION OF THE DRAWINGS

Further features, details and advantages of the invention will become apparent from the subsequent description of preferred embodiments given with reference to the drawings. In the drawings:

FIG. 3 is a perspective view of a TV set as an example of the device according to this first embodiment;

FIG. 4 is a simplified sectional drawing of the TV set of FIG. 3 taken along the plane defined by lines IV—IV of FIG. 3.

DETAILED DESCRIPTION OF PREFERED EMBODIMENTS

Figure 1:
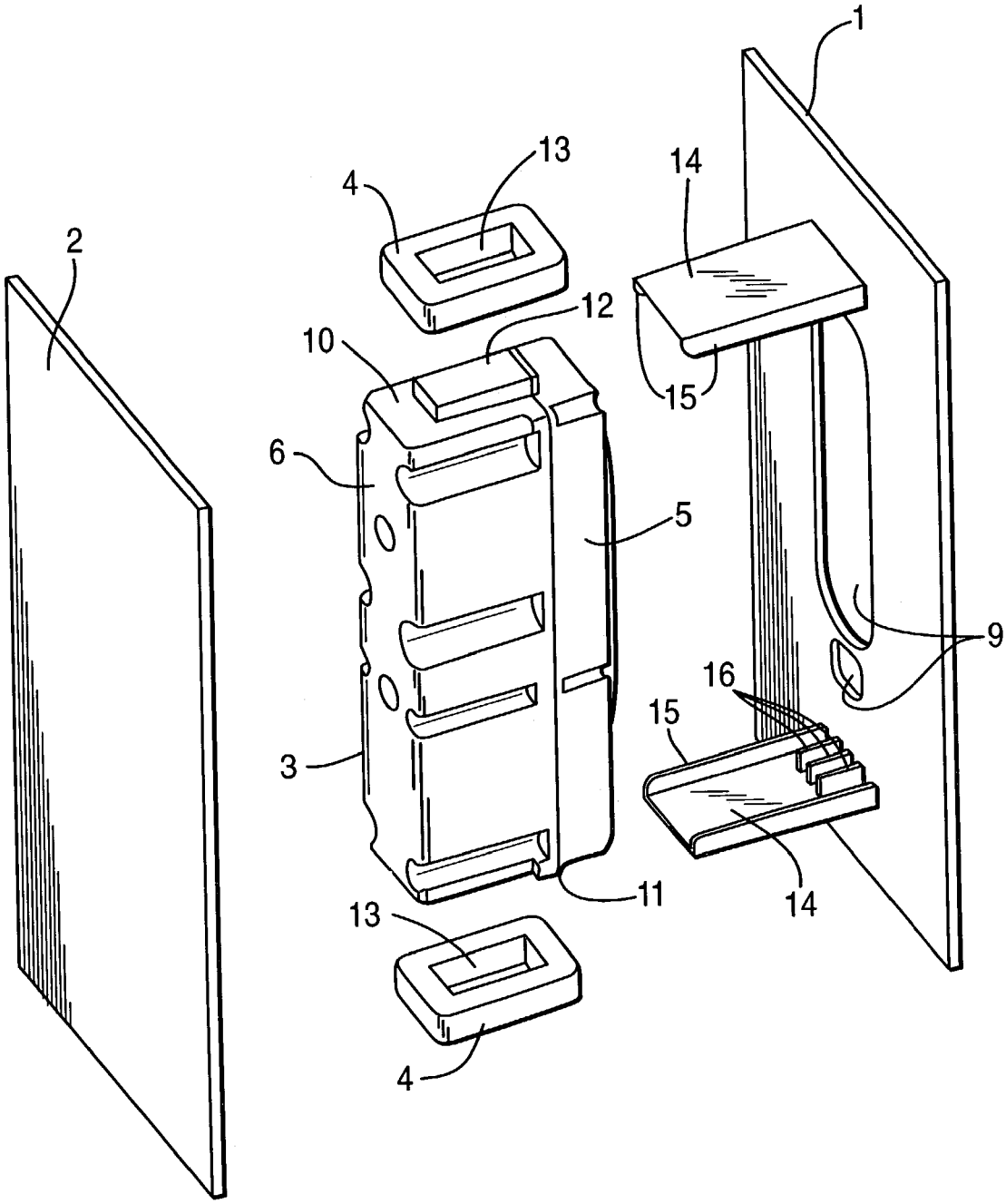
FIGS. 1 and 2 are exploded perspective views of first and second walls, vibration absorbing bodies and a loudspeaker unit according to a first embodiment of the invention.
Figure 2:
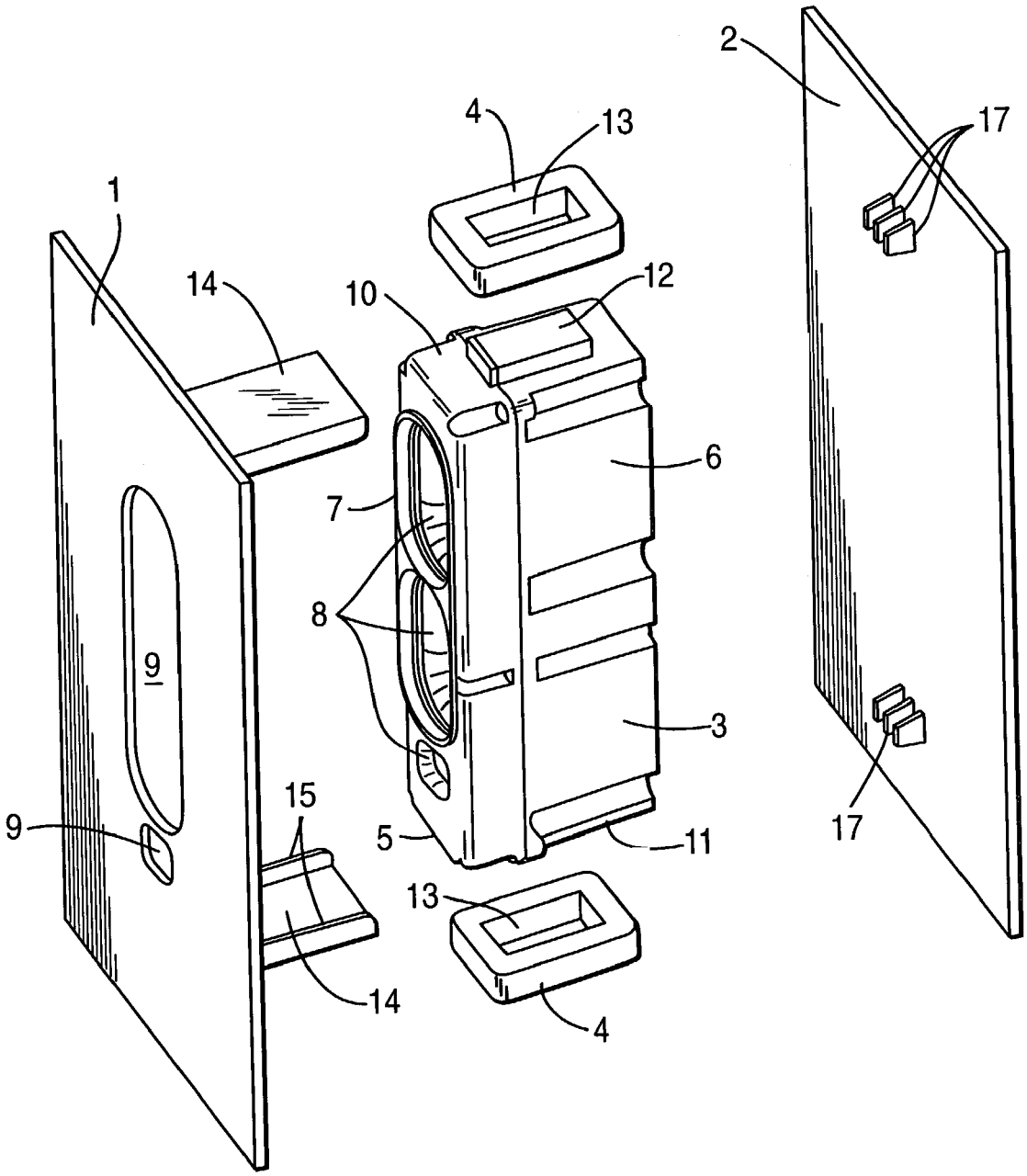

FIGS. 1, 2 show part of a front wall 1 of a casing of a TV set, part of its rear wall 2, and a loudspeaker unit 3 to be mounted between walls 1, 2 by means of annular-shaped vibration absorbing bodies 4. The front wall 1 is a part of the cabinet of the TV set whereas the rear wall 2 is a part of the back cover.

The loudspeaker unit 3 is a loudspeaker enclosure, i.e. a preassembled unit formed of front and rear housing elements 5, 6 held together by means of screws or bolts. A front surface 7 of front housing element 5 has a number of openings 8 behind which individual loudspeakers are installed.

At top and bottom surfaces 10, 11 of loudspeaker unit 3, rectangular projections 12 are provided. These projections correspond in shape to through holes 13 of vibration absorbing bodies 4. The height of the projections 12 is less than the thickness of the vibration absorbing bodies 4, so that when the vibration absorbing bodies are placed at top and bottom surfaces 10 and 11, the projections 12 are concealed within through holes 13.

The vibration absorbing bodies 4 are formed of a conventional foamed plastics material which can be resiliently compressed.

Two support arms 14 project from the inside of front wall 1. These support arms 14 are parallel to each other, and their distance is a bit less than the overall height of the loudspeaker unit 3 with both vibration absorbing bodies 4 mounted to it, but more than the height of the loudspeaker unit 3 alone, so that by softly compressing the vibration absorbing bodies 4, these and the unit 3 can be inserted between the support arms 14 without any of the projections 12 touching a support arm 14. In the present embodiment each support arm 14 has two lateral ridges 15 at a distance corresponding to the width of the vibration absorbing bodies 4, so that the loudspeaker unit 3 can be inserted between the support arms 14 from the rear but cannot move left or right. I.e. the support arms 14 and their ridges 15 form rails that guide the displacement of the loudspeaker unit during assembly. The insertion movement of the loudspeaker unit 3 comes to an end when the vibration absorbing bodies 4, and specifically their front lateral face, come into contact with abutments 16 formed in the front wall 1 at the base of support arms 14. The height of the abutments 16 is less than the thickness of the vibration absorbing bodies 4 in their compressed state, so that the abutments 16 can never come into direct contact with the housing of the loudspeaker unit 3.

These abutments might for example be formed as solid walls extending perpendicularly to the insertion direction of the loudspeaker unit 3. In the present embodiment, however, the abutments 16 are short ribs parallel to the lateral ridges 15, which provide only for a very small area of contact with the vibration absorbing bodies 4. The advantage of such an arrangement is twofold. On the one hand, such ribs are easily formed by injection molding in one piece with the front wall 1 and the support arms 14, the other is that if the space between front and rear walls available for the loudspeaker unit varies due to manufacturing tolerances, this can be easily absorbed by the ribs 16 intruding more or less deeply into the flexible material of the vibration absorbing bodies without compressing these too strongly, so that the dampening properties remain essentially unaffected by such variations.

The rear wall 2 has no support arms 14, but it has upper and lower inwardly projecting bosses 17, the shape of which is similar to the abutments 16 of front wall 1 and which are located at the same level as these, so that when the device is assembled, the vibration absorbing bodies 4 will be immobilized in forward and rearward directions by the abutments 16 and bosses 17.

The loudspeaker unit 3 is thus held in every direction through the vibration absorbing bodies 4. In this way, the loudspeaker unit 3 is totally suspended which gives very good acoustic and mechanical results.

FIG. 3 is a perspective view of a TV set 20 as an example of an electronic device according to the present invention. The housing of the TV set 20 is essentially constituted of two injection-molded elements, a front element 21 (cabinet) of which the front wall 1 is part, and a rear element 22 (back cover) of which the rear wall 2 is part. The loudspeaker openings 9 show at both sides of CRT tube 23.

FIG. 4 is a cross section of the TV set 20 in the plane defined by lines IV—IV, showing the components described with respect to FIGS. 1 and 2, already, in an assembled state. The loudspeaker unit 3 is immobilized exclusively by its top and bottom projections 12 engaging the through holes 13 of vibration absorbing bodies 4. These, in turn, are held in vertical directions by support arms 14, in left and right directions (perpendicular to the plane of FIG. 4) by ridges 15 and in front and rear directions (to the left and right in FIG. 4) by abutments 16 and bosses 17 of front and rear walls 1, 2.

The length of the abutments 16 and bosses 17 is chosen such that the loudspeaker unit 3 will not come into direct contact with either wall 1 or 2 and can thus not transmit any vibrations directly to it.

Figure 5:
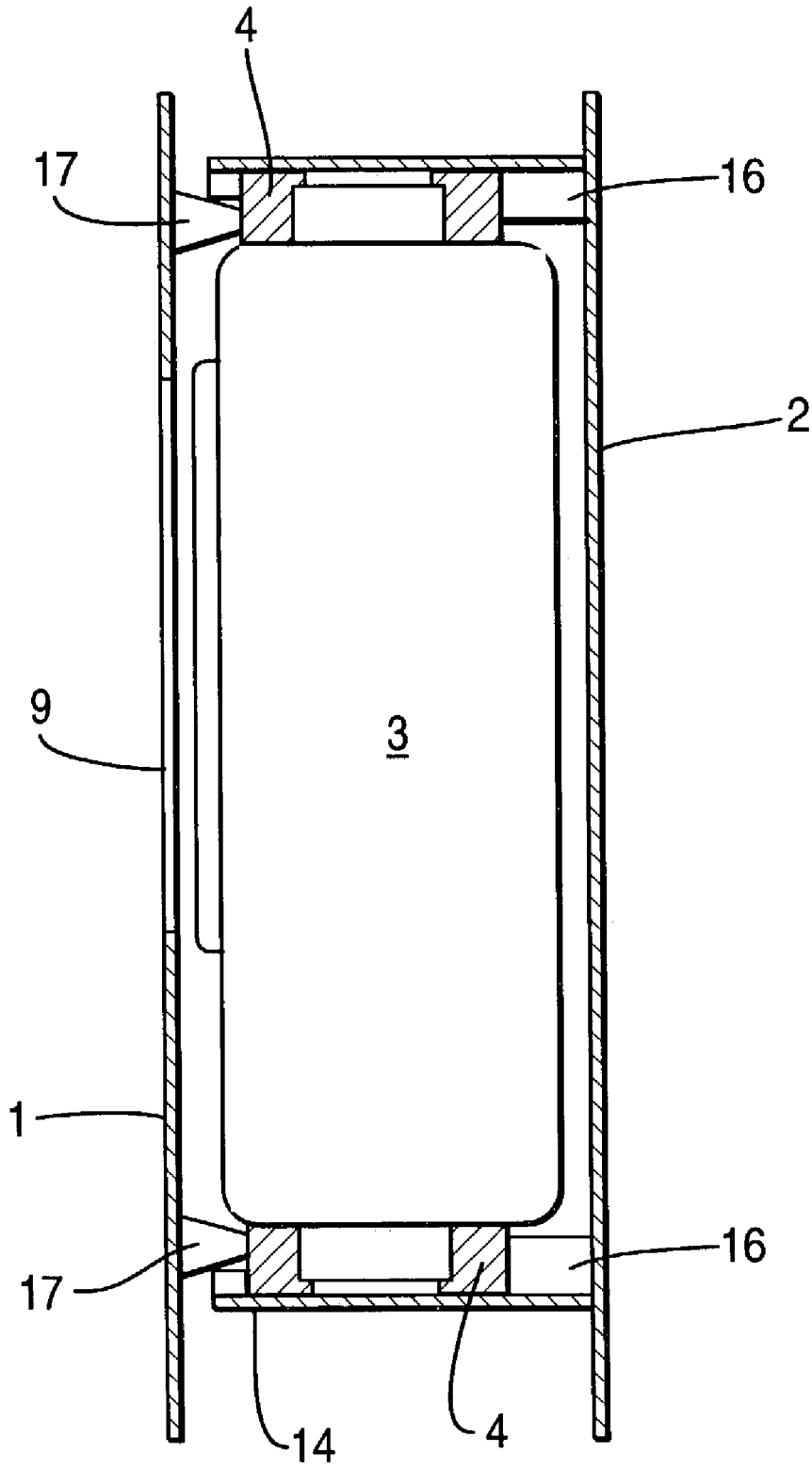
FIGS. 5 and 6 are sectional views analogous to that of FIG. 4, of second and third embodiments of the invention.

FIG. 5 is a sectional view analogous to FIG. 4 of a second embodiment of the invention. In this embodiment, the loudspeaker unit 3 and the vibration absorbing bodies 4 are the same as in FIG. 3, but the roles of front and rear walls 1, 2 have been exchanged. Here, it is the rear wall 2 that bears the support arms 14 and abutments 16, whereas the front wall 1 has bosses 17 for pushing the loudspeaker unit 3 and the vibration absorbing bodies 4 against the abutments 16 of the rear wall 2.

Figure 6:
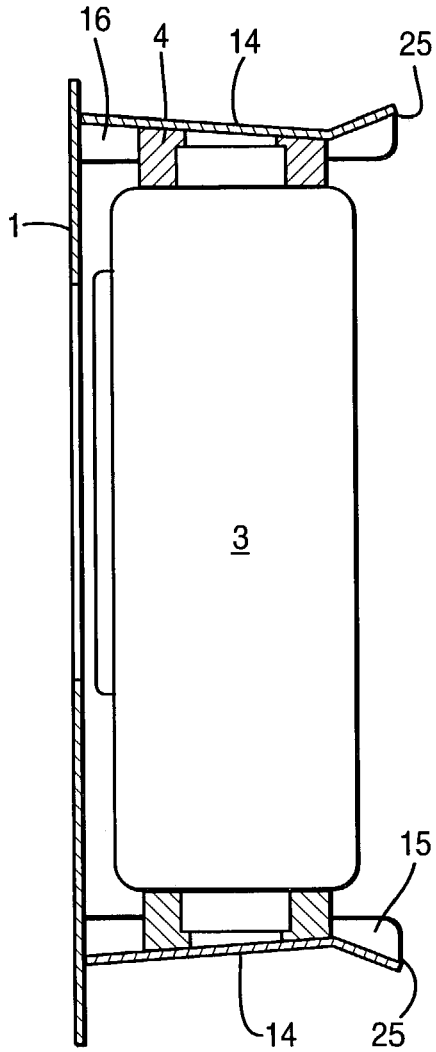

A third embodiment of the invention is shown in the sectional view of FIG. 6. This embodiment differs from that of FIGS. 1 to 4 in that the support arms 14 are no longer parallel but converge towards their distal ends 25 over a major part of their length. The result of this feature is that when the vibration absorbing bodies 4 are in contact with the abutments 16, as shown in FIG. 6, the compression is less than it would be if the loudspeaker unit 3 was displaced to the right in FIG. 6. Accordingly, the loudspeaker unit 3 is firmly held in this position without the need for projections 17 of the rear wall 2 (not shown) to keep it there. This embodiment is particularly suited if the distance between front and rear walls of the device casing is much greater than the depth of the loudspeaker unit 3, and bosses 17 of the rear wall, if provided, would have to be inconveniently long.

Another peculiarity of this embodiment is that in proximity of their distal ends 25, the support arms 14 are divergent. Preferably, the distance between the free ends 25 is more than the overall height of the loudspeaker unit 3 and the vibration absorbing bodies 4 in their uncompressed state. Due to this feature, the loudspeaker unit 3 can be easily inserted between the support arms 14 without having to compress the vibration absorbing bodies 4 before.

Of course, the peculiar features of this embodiment can be combined with those of the second embodiment.

Figure 7:
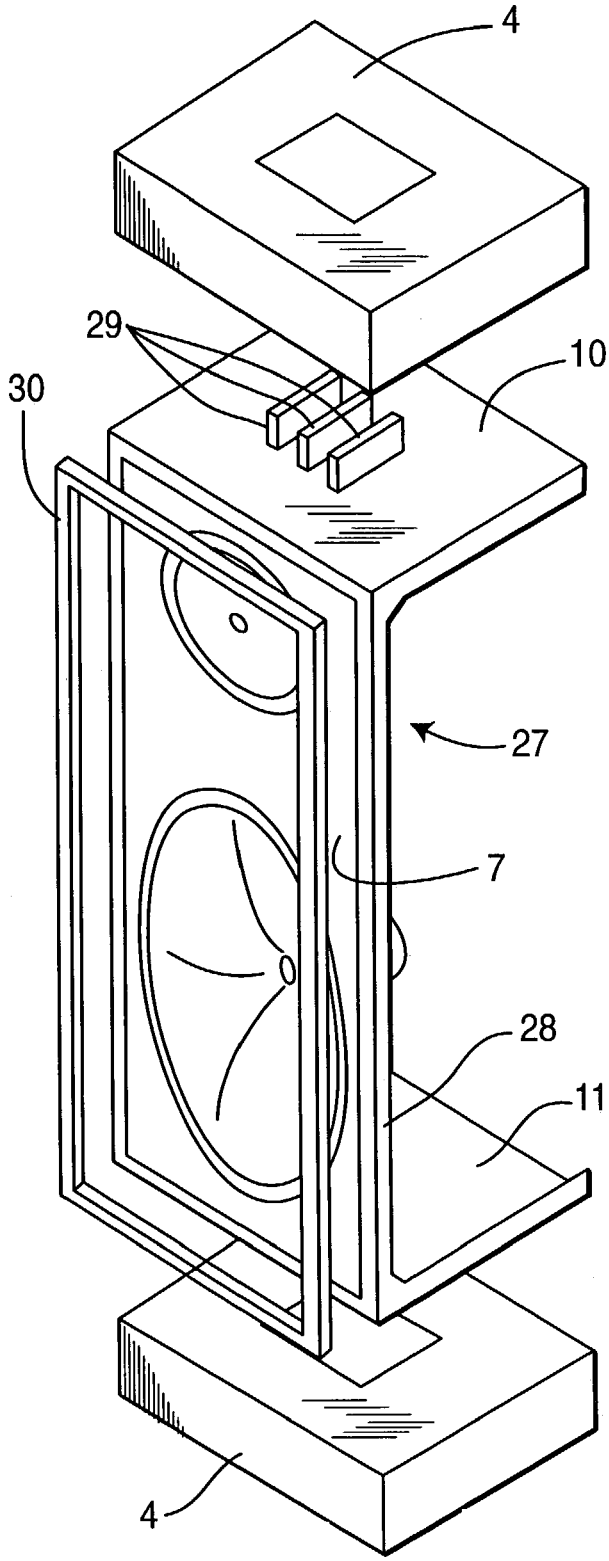
FIG. 7 is an exploded perspective view of a loudspeaker unit and vibration absorbing bodies according to a fifth embodiment of the invention.

FIG. 7 is a perspective view of a loudspeaker unit 3 according to a fourth embodiment of the invention. This embodiment has several peculiar features which can be used alone or in combination with any of the embodiments described before.

A first peculiar feature is that the loudspeaker unit does not have a closed housing but only a frame 27 having top, bottom and front surfaces 10, 11, 7 but no left, right or rear surface. It is stabilized by ribs 28, extending at its left and right hand sides (only the right hand side rib is shown in the FIG. 7), so that it can withstand compression of the vibration absorbing bodies 4 without being bent.

In order to facilitate molding of the frame 27, there is not one solid projection at top and bottom surfaces 10, 11, but a plurality of narrow walls 29, that can be easily shaped by simple molding tools moveable only in front and rear directions.

Another peculiarity of this embodiment is a third vibration absorbing body 30, which is, in FIG. 7, shown separate from the frame 27 but which, in the assembled device, is adhered to the edges of front surface 7.

Figure 8:
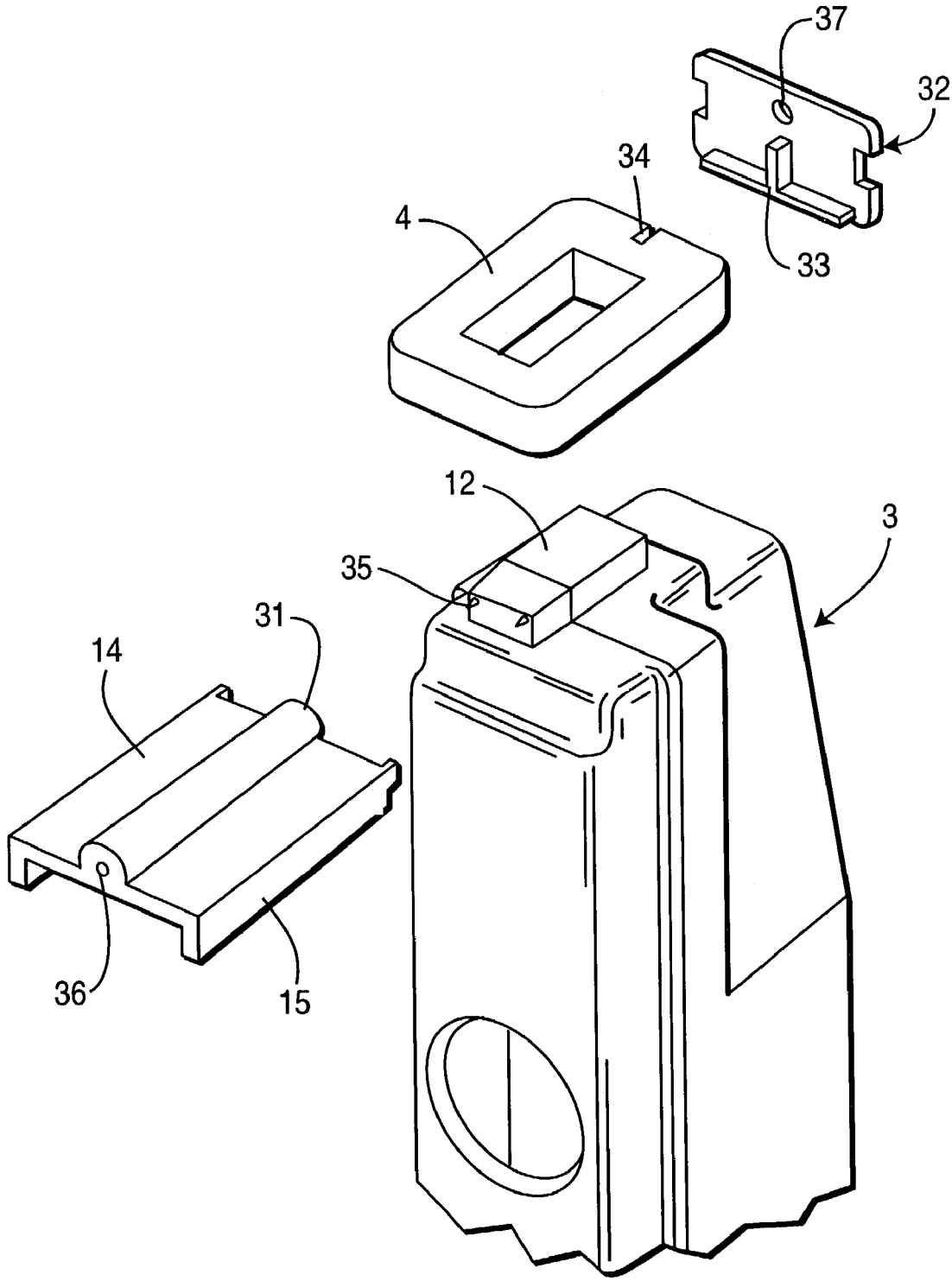
FIG. 8 is an exploded perspective of a fifth embodiment of the invention.

A fifth embodiment of the invention is represented on the partial perspective view of FIG. 8. According to this embodiment, a support arm 14 (only partially represented) of the front wall 1 has a cylindrical protrusion 31, preferably with a small-diameter hollowing-out 36. The axis of the cylindrical protrusion 31 corresponds to the mounting direction of the loudspeaker unit 3.

A plate 32 is affixed to the free end of the support arm 14 by screwing; for this purpose, the plate 32 has a through-hole 37 through which a screw can be screwed to the cylindrical protrusion 31 at the hollowing-out 36. The plate 32 is meant to retain the vibration absorbing body 4 in the rearward direction (In this regard, the plate has the function of the bosses 17 of the first embodiment.)

The fifth embodiment is thus particularly suited when the rear wall 2 is too distant from the front wall 1 to be used as an abutment in the rearward direction.

In order to further enhance retention of the various parts, a pin or pins 35 are provided on the rectangular projections 12 to contact the vibration absorbing body 4 and a protrusion 33 on the plate 32 is provided in correspondence with a recess 34 in the vibration absorbing body 4.

In the fifth embodiment, the mounting operations can consequently be the following ones : first the vibration absorbing body 4 is mounted to the loudspeaker unit 3 ; then the loudspeaker unit 3 is mounted to the front wall 1 at the level of the support arm 14. Lastly, the plate 32 is screwed to the support arm 14 whereby complete retention of the loudspeaker unit 3 is obtained.

Another solution to mount the loudspeaker unit 3 to the electronic device is the following one : the plate 32 can be adhesively bonded to the vibration absorbing body 4 beforehand, at the level of the protrusion 33 and recess 34. The final assembly is then simplified : by mounting the vibration absorbing body 4 with plate 32 onto the loudspeaker unit 3 and by engaging the loudspeaker unit 3 between the support arms 14, the trough-hole 37 comes to facing the cylindrical protrusion 31.

The loudspeaker unit 3 can thus be retained by screwing the plate 32 to the front wall 1.

The above description of the fifth embodiment refers to only one of the vibration absorbing body 4 but naturally it also applies to the other vibration absorbing body 4.

Another possible solution to improve the retention of the vibration absorbing body 4 on the corresponding projection 12 of the loudspeaker unit 3 is to provide that the projection 12 is thicker and wider than the through hole 13 in a cross-section, for instance in the direction of mounting of the loudspeaker unit 3. The support arm 14 must then have a corresponding opening to receive the thick part of the projection 12. The vibration absorbing body 4 is thus mechanically held between the top or bottom surface 10,11 of the loudspeaker unit and the wider section of the projection 12.

In the embodiments described above, the loudspeaker unit 3 has always been shown to be supported by support arms 14 projecting in a cantilever manner from one of the walls 1 or 2. Of course, the loudspeaker unit might just as well be supported by a bottom wall of the device casing and an upper support arm or a top wall of the casing, or by a lower support arm and a top wall of the casing. Ridges analogous to above-described ridges 15 may be provided on top and/or bottom walls as required to form guide rails for the loudspeaker unit thereon, or other means for preventing a displacement of the loudspeaker unit to the left or right may be provided instead.

In the above description, the loudspeaker unit 3 receives two absorbing bodies 4. However, the invention is not limited to this possibility. It also applies to solutions with one absorbing bodies and to solutions with more than two absorbing bodies.

What is claimed is:

1. An electronic device comprising:

a loudspeaker unit, a casing with at least one support for receiving the loudspeaker unit, at least one vibration absorbing body forming a spacer between the loudspeaker unit and one of the at least one support.

wherein the loudspeaker unit is held in every direction through the at least one vibration absorbing body, and wherein at least one support has lateral ridges so as to form rails adapted to guide a displacement of the loudspeaker unit in a mounting direction.

2. An electronic device according to claim 1, wherein the at least one vibration absorbing body is made of foamed plastic material.

3. An electronic device according to claim 1, wherein at least one vibration absorbing body is shorter than the loudspeaker unit in a mounting direction.

4. An electronic device according to claim 1, wherein the electronic device comprises:

a casing with at least two support for receiving the loudspeaker unit, at least two vibration absorbing bodies, each forming a spacer between the loudspeaker unit and one of the at least two supports.

5. An electronic device according to claim 1, wherein the loudspeaker unit has at least one rectangular projection carrying each of the at least one vibration absorbing body.

6. An electronic device according to claim 5, wherein the at least one rectangular projection is provided with at least one pin contacting each of the at least one vibration absorbing body.

7. An electronic device according to claim 1, wherein a plate is mounted to the at least one support in a mounting direction and stops the at least one vibration absorbing body.

8. An electronic device according to claim 7, wherein the plate is adhesively bonded to the at least one vibration absorbing body.

9. An electronic device according to claim 7, wherein a protrusion of the plate engages a recess in the at least one vibration absorbing body.

10. An electronic device according to claim 1, wherein at least one abutment protruding from a wall in a mounting direction contacts the at least one vibration absorbing body.

11. An electronic device according to claim 1, wherein the device is a television set.

* * * * *